US005782453A

United States Patent [19]

Tuzza et al.

[11] Patent Number: 5,782,453

[45] Date of Patent: Jul. 21, 1998

[54] DECORATIVE TREE PLANTER STAND

[76] Inventors: Lou Ann Tuzza, 19 Oakland St., East Patchogue, N.Y. 11772; Nancy Barrie, P.O. Box 921, Remsenberg, N.Y. 11960

[21] Appl. No.: 764,941

[22] Filed: Dec. 13, 1996

[51] Int. Cl.[6] ..... F16M 13/00

[52] U.S. Cl. ..... 248/523; 248/519; 47/66.6

[58] Field of Search ..... 47/66.6, 32; 248/519, 248/523, 346.03, 346.5

[56] References Cited

U.S. PATENT DOCUMENTS

| | | | |
|---|---|---|---|
| 2,905,414 | 9/1959 | Zierden | 47/40.5 |
| 3,052,437 | 9/1962 | Schoen | 47/40.5 |
| 4,261,138 | 4/1981 | St. George Syms | 248/523 X |
| 4,403,443 | 9/1983 | Valente | 47/32 |
| 5,398,444 | 3/1995 | Murray | 248/515 X |

FOREIGN PATENT DOCUMENTS

| | | | |
|---|---|---|---|
| 2629176 | 9/1989 | France | 248/523 |
| 2208591 | 4/1989 | United Kingdom | 248/523 |

*Primary Examiner*—Ramon O. Ramirez
*Assistant Examiner*—Willie Berry, Jr.
*Attorney, Agent, or Firm*—James J. Romano, Jr.

[57] ABSTRACT

A tree planter stand adapted to stabilize, attractively support, and display a Christmas Tree. The stand includes a support stanchion insert disposed within the planter and a tree trunk riser extending upwardly thereof and operable to receive and support a tree trunk. The stanchion insert has a cover which includes a lower facing generally circular support rim sized to overlie and abut the planter support ridge. A central drain plug is provided in the bottom of the stanchion insert to drain any excess water.

4 Claims, 3 Drawing Sheets

FIG. 1
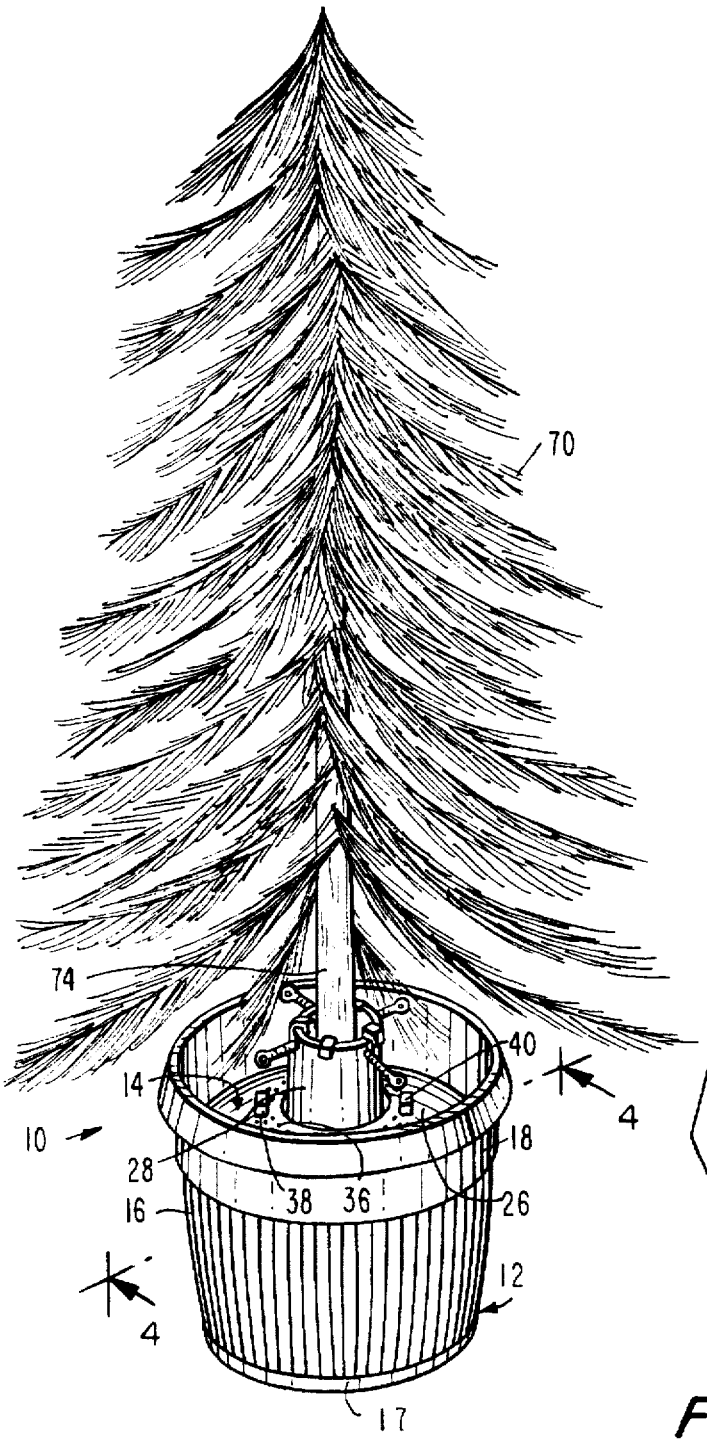
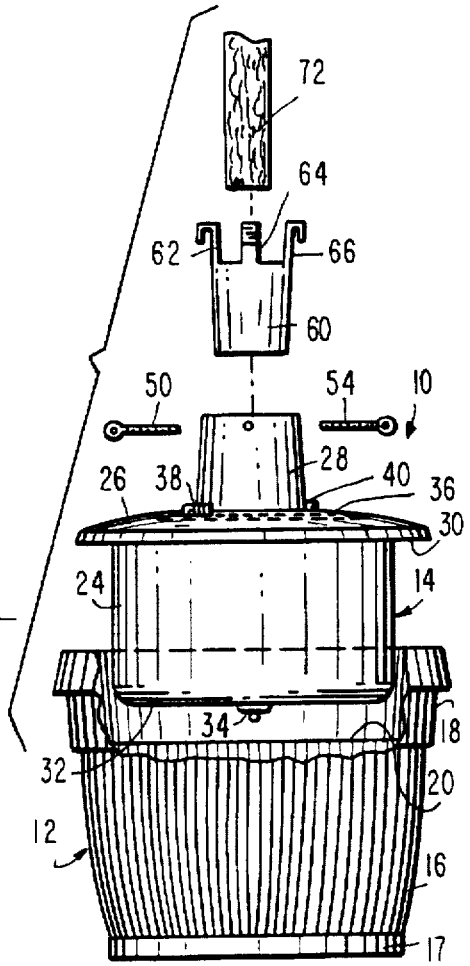
FIG. 2

FIG. 3
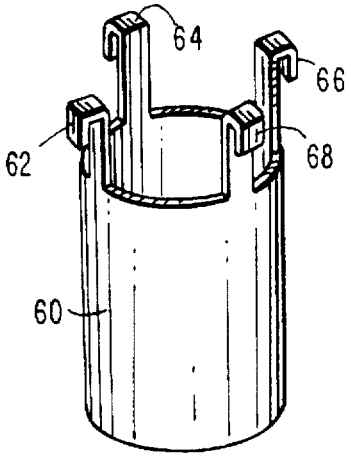
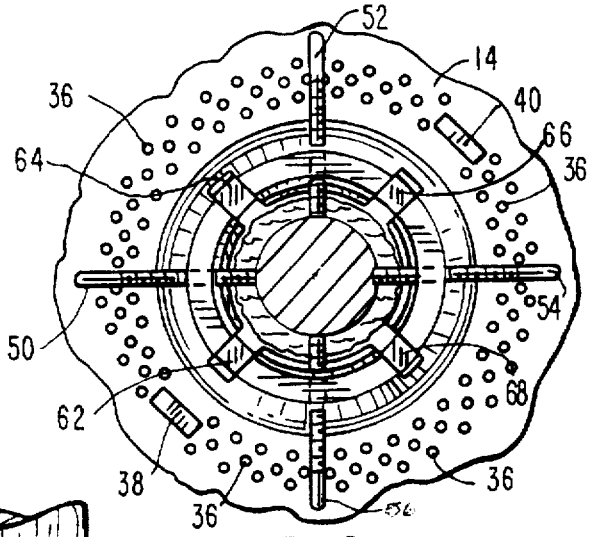
FIG. 5
FIG. 4
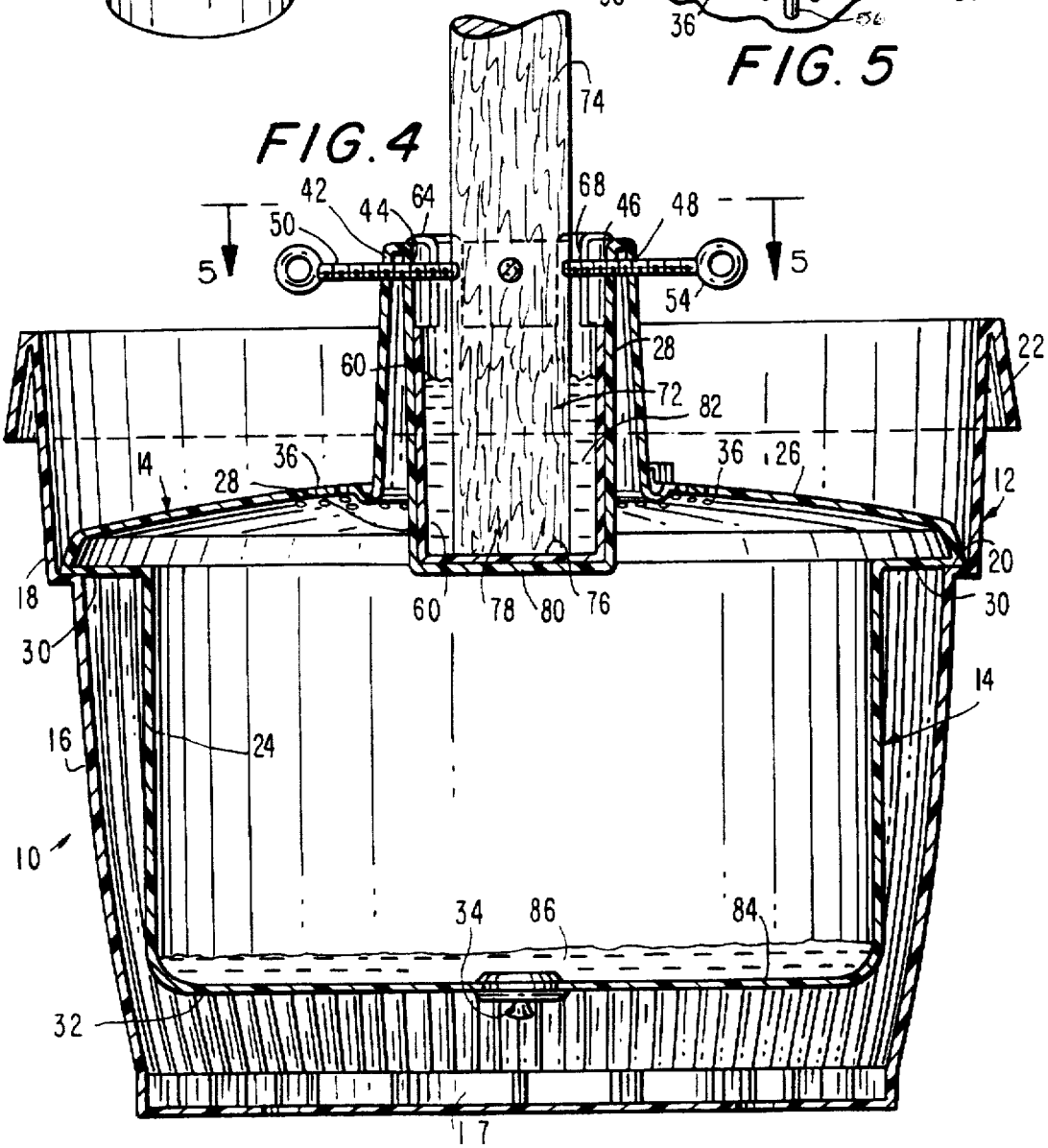

DECORATIVE TREE PLANTER STAND

BACKGROUND OF THE INVENTION

1. Field of the Invention

This invention relates to a new and improved decorative tree planter stand which is particularly though not exclusively adapted to the stable and attractive support and display of a Christmas Tree.

2. Description of the prior art

Although a wide variety of decorative tree support stands are known in the prior art, none are known which provide the significant advantages of the decorative tree planter of our invention or which, taken singly or in valid combination, would function to anticipate or make obvious the teachings of that invention.

More specifically, and considering first U.S. Pat. No. 3,052,437 to Schoen, the Christmas Tree Holder disclosed therein will be seen to comprise a circular collar 11 including spaced legs 12 extending downwardly therefrom and joined by a base plate 13 to provide support for the base of the trunk of a Christmas Tree. Three equally spaced arms 17 extend radially outwardly from the circular collar 11 for attachment by flanges 18 at the circumference of the open top of a cylindrical, tree-support container 23, either by friction fit or set screws 19. Set screws 14 secure the tree trunk base in the circular collar support. The container 23 may be filled with water as ballast; and this ballast water would, of course, contact the supported tree trunk base through the spaces between the legs 12 to moisten the same.

Considering next U.S. Pat. No. 5,484,131 to Aldrete et al, the Tree Levelling Stand disclosed therein comprises a cup 6 carrying spaced thumb screws 26 at the cup sides and a pin projection 24 in the cup bottom 22 for gripping and securing the base of Christmas tree in the cup 6. The cup 6 is supported in angularly adjustable manner in recess opening 8 in a frusto conical base support member 4 by bolt 28 and thumb screw 32. The cup 6 contains water to moisten the base of the Christmas tree trunk as supported therein; and a monitoring device including a micro chip 38 and LED 44 is provided for monitoring the level of the water in the cup 6. The cup 6 and the base member 4 may be fabricated from plastic.

The Adjustable Tree Stand disclosed by U.S. Pat. No. 5,398,444 to Murray will be seen to comprise a circular support clamp 12 including ring 20, thumb screws **28*a*, 28*b*, 28*c* and 28*d*, and support brackets 22 and 24 which are welded to the inside of the ring 20 to form a support for the base of the trunk of a Christmas tree, and include spikes for projecting thereinto to that effect in combination with the aforementioned thumb screws. The support clamp 20 fits into a cylindrical collar 14, which can be made of plastic; and the collar 14 in turn fits into a socket 44 carried by spaced inclined support arms 50 which are welded to the bottom face 45 of the rim of the socket 44 and to the top face of a support ring 52. A depending wall portion or rim 54 of the support ring 52 overlies the top edge of a frusto-conical water pan 40 for support therefrom; and the complementally concave-convex configurations of the collar 14 and socket 44 enable angular adjustment in the orientation of the supported Christmas tree. Of course, the water in the water pan 40** contacts and moistens the supported base of the Christmas tree trunk.

The Tree Stand disclosed by U.S. Pat. No. 4,034,505 to Lydall comprises a frusto-conical base 12 including centrally located spikes 18 extending upwardly from the base bottom, and an inverted saucer-shaped cover 14 which removably overlies the base 12. The cover 14 includes a central circular opening 26, and a semi-circular collar 32 extends upwardly from the cover 14 to partially surround the same. Engaging screws 36 extend through the collar 32, and an elongate wedge 42 is slidably mounted atop the cover 14 to cooperate with the engaging screws 32 and spikes 18 to adjustably frictionally engage the base portion of a tree trunk for support from the base 12. Spaced fluid fill holes 52 are provided in the cover 14 for filling of the same with water; and a generally cylindrical insert 22 may be centrally disposed on ring edge **16*a* at the bottom of base 12 to prevent water from contacting the trunk of the supported tree, or may be removed therefrom to allow such contact. Both the base 12 and cover 14** may be made of plastic.

U.S. Pat. No. 1,900,807 to Fegley et al discloses a Christmas Tree Holder comprising a base 2 which includes four equally spaced support legs 5 extending outwardly thereof, and a receptacle 3 for the support of the lower end of the tree, and which is secured to the base 2 by screws 9 which extend through mating base and receptacle flanges 7 and 8. An array of spaced lamps 18 are mounted in electrical sockets 12 supported by holders 13 on a carrying ring 14 which is attached to the underside of the base 2. Spaced screws 11 extend through a series of lugs 10 at the top of the receptacle 3 to secure the base of the trunk of a Christmas tree therein and support the tree from the base 2, and water may be placed in the receptacle 3 to moisten the tree.

OBJECTS OF THE INVENTION

It is, accordingly, an object of our invention to provide a decorative tree planter stand which is of particularly simple and economical construction.

It is another object of our invention to provide a decorative tree planter stand as above which operates to support a decorative tree in particularly stable manner.

It is another object of our invention to provide a decorative tree planter stand as above which, in accordance with its inherent stability, enables movement of a supported decorative tree to different locations with minimal risk of upset.

It is another object of our invention to provide a decorative tree planter stand as above which operates to support a decorative tree in particularly eye-pleasing and attractive manner, and which can be effective to raise the level of the supported tree to increase the visibility thereof.

It is another object of our invention to provide a decorative tree planter stand as above including virtually leak-proof water supply reservoir to moisten the trunk of the supported tree and maintain the freshness thereof.

It is another object of our invention to provide a decorative tree planter stand as above which readily lends itself to decorative embellishment in accordance with the decorative motif of the supported tree.

It is another object of our invention to provide a decorative tree planter stand as above which requires only low cost, readily available components, in part "off-the shelf," and materials of proven durability and dependability in the fabrication thereof to thereby insure low production costs and a long period of virtually maintenance-free operational life.

It is a further object of our invention to provide a decorative tree planter stand as above which is particularly adapted to the support of Christmas trees.

It is further object of our invention to provide a decorative tree planter stand as above which, by the simple elimination of tree support components and equally simple substitution of a single plant support component, can operate to attractively and stably support a variety of potted plants or the like.

It is a still further object of our invention to provide a decorative tree planter stand as above which is equally suitable for indoor or outdoor use.

DESCRIPTION OF THE DRAWINGS

The above and other objects and significant advantages of our invention are believed made clear by the following detailed description thereof taken in conjunction with the accompanying drawings wherein:

FIG. 1 is a perspective view of a new and improved decorative tree planter stand configured and operable in accordance with the teachings of our invention and illustrating the support of a Christmas Tree thereby;

FIG. 2 is an exploded view of the new and improved decorative tree planter stand of FIG. 1, with parts broken away, and includes the depiction of a portion of the trunk of a tree to be supported therein;

FIG. 3 is a perspective view of the water supply reservoir of the tree planter stand of FIG. 1;

FIG. 4 is a cross-sectional view taken generally along line 4—4 of FIG. 1;

FIG. 5 is a cross-sectional view taken generally along line 5—5 of FIG. 4;

SUMMARY OF THE INVENTION

Figure 7:
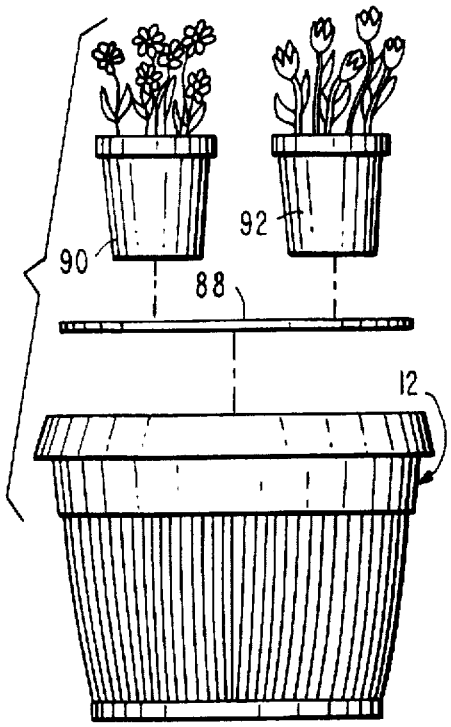
FIG. 7 is an exploded view of the planter of FIG. 6, and includes the depiction of the potted plants as supported thereby.

As disclosed herein, the new and improved decorative tree planter stand of our invention makes use of a conventional, open-topped planter into which is emplaced a generally cylindrical support stanchion insert. The stanchion insert includes an enlarged, generally circular cover with an array of water drainage holes formed therein, and is supported within the planter by an internal, planter support ridge upon which the stanchion cover rests. The stanchion insert further includes a centrally disposed, generally cylindrical open-topped tree trunk support riser extending upwardly from the stanchion insert cover; and a complementally sized and shaped water basin insert is provided for disposition in and support from the tree trunk support riser. Attachment bolts are threaded at equally spaced intervals through the tree trunk support riser.

In use, the lower portion or stump of a decorative tree, for example a Christmas tree, is placed in the water basin insert with the bottom of the tree stump in firm, supporting abutment with the bottom of the water basin insert, and the attachment bolts tightened through the support riser to very firmly grasp the tree trunk stump and maintain the same very securely supported within the water basin insert, and thus within the planter. Water is poured into the water basin insert to contact the tree trunk stump and moisten the same to maintain the freshness of the tree, and any excess water which may overflow the basin insert will simply run down the top of the stanchion insert and through the water drainage apertures into the interior of the stanchion insert.

For off-season use of the planter, a simple circular plate replaces the stanchion insert and is supported within the planter from the aforementioned internal planter support ridge to provide a surface for the support of a variety of potted plants or the like from the planter.

DETAILED DESCRIPTION OF THE INVENTION

Referring now to FIGS. 1, 2 and 5 of the application drawings, a decorative tree planter stand configured and operable in accordance with the teachings of our invention is indicated generally at 10; and comprises a stepped, generally frusto-conical, open topped ribbed planter as indicated generally at 12, and a complementally sized and shaped, generally cylindrical tree support stanchion insert as indicated generally at 14. Planters in the nature of 12 are readily available at relatively low cost as "off-the-shelf" items in a variety of sizes from nurseries, plant supply houses and discount chains and the like, and are generally fabricated from moulded plastic which offers the advantages of low cost, light weight, high strength and high resistance to most forms of corrosion. An example of planters of this nature are those marketed under the trademark ^RC^. In addition, these planters are normally available in a variety of colors as may be appropriate to the occasion for which the decorative tree planter stand of our invention is to by employed.

As best seen in drawing FIGS. 1, 2 and 4, planter 12 comprises a lower body portion 16 which includes a ribbed bottom 17, and an upper body portion 18 which respectively meet as shown to form an internal, generally torus-shaped support ridge as indicated at 20. The upper body of the planter 12 includes a downturned upper rim 22 which lends strength and attractiveness to the planter.

Support stanchion insert 14 comprises a generally cylindrical, hollow main body portion as indicated at 24; and an integral, enlarged generally discus-shaped cover as indicated at 26 and which in turn includes an integral, generally cup-shaped, open-topped tree trunk support riser formed centrally of the cover 26 as indicated at 28 to extend upwardly therefrom and then downwardly thereinto to form the depicted, essentially concentric double-walled structure.

As best seen in FIG. 4 of the application drawings, stanchion insert cover 26 includes a lower, downwardly facing generally circular support rim as indicated at 30 and which, upon placement of the stanchion insert 14 into the planter 12 as described in greater detail hereinbelow, is sized and functions to overlie and abut the planter support ridge 20 to support the stanchion insert 14 within the planter 12 with the bottom 32 of the stanchion insert 14 spaced above the bottom 17 of the planter 12. A central drain plug as indicated at 34 is provided in the bottom 32 of the stanchion insert 14.

As best seen in drawing FIG. 5, a generally circular array of spaced drain holes 36 is formed as shown in the cover 26 of the stanchion insert 14 to surround the support riser 28 for purposes described in detail herein below; while a pair of diametrically opposed, spaced handles 38 and 40 are provided as shown on cover 26 to enable the ready and convenient placement of the stanchion insert 14 in the planter 12 and the removal of the same therefrom.

Four pairs of aligned equally spaced threaded apertures, as indicated at 42 and 44, and 46 and 48, respectively in FIG. 4 for two, only, of those pairs, are formed as shown to extend at 90° intervals through the double walls of the support riser 28 just below the top of the same; and four complementally threaded steel attachment bolts 50, 52, 54 and 56 are provided to respectively extend through those aligned threaded aperture pairs for purposes described in detail herein below.

In the manner of the planter 12, the support stanchion 14 is also preferably made of a moulded plastic of an appropriate color.

A generally cylindrical, open topped water basin insert is indicated at 60, and comprises four equally spaced, bent over handles 62, 64, 66 and 68 formed integrally therewith at 90° intervals to extend upwardly therefrom at best seen in drawing FIG. 3. The water basin insert 60 is sized to fit within the opening in the support riser 28. Preferably, the water basin insert 60 is fabricated from steel to provide for particularly high strength characteristics thereof.

In use for example, of the tree planter stand 10 of our invention, for the particularly stable and attractive support of a Christmas tree as shown at 70 in drawing FIG. 1, it may be understood that the support stanchion insert 14 is emplaced as best seen in FIGS. 1 and 4 within the planter 12 with the lower rim 30 of the stanchion cover 26 resting firmly on the inner support ridge 20 of the planter to securely support the stanchion within the planter.

The water basin insert 60 is then emplaced, again in the manner best seen in drawing FIGS. 1 and 4, in the opening in the support riser 28; with the bent over portions of the support handles 62, 64, 66 and 68 of the insert 60 abutting and extending as best seen in FIGS. 1 and 5 over the top edge of the riser 28, and the respective riser and insert side and bottom walls in abutment as best seen in drawing FIG. 4, to respectively insure the particularly secure and stable emplacement of the insert 60 in the stanchion 14, and thus in the planter 12.

The four attachment bolts 50, 52, 54 and 56 are then respectively inserted and loosely screwed into the four equally spaced pairs of aligned threaded apertures, which include 42 and 44, and 46 and 48, in the double walls of the support riser, to extend therethrough between the respective spaced insert handles 62, 64, 66 and 68; whereupon the lower portion or stump 72 of the trunk 74 of the Christmas tree 70 is emplaced vertically all the way into the insert 60 between the spaced attachment bolts 50, 52, 54 and 56 so that the essentially flat bottom 76 of the lower tree trunk portion 72 comes into firm and supportive abutment with the flat upper surface 78 of the insert bottom 80. The four attachment bolts 50, 52, 54, and 56 are then very tightly screwed through the relevant threaded apertures to respectively abut and actually pierce to a limited degree the lower tree trunk portion 72, all as best seen in application drawing FIGS. 4 and 5, to, in combination with the abutment as heretofore described of the tree trunk bottom 76 with the insert bottom surface 78, very securely grasp and support the Christmas tree 70 in and from the tree planter stand 10 of our invention in the manner best shown from an overall perspective in application drawing FIG. 1.

With the Christmas tree 70 supported as heretofore described in and from the tree planter stand 10, water as indicated at 82 in application drawing FIG. 4 is then poured into the insert 60 to contact and moisten the lower tree trunk portion or stump 72, and thus, as is widely believed, the Christmas tree 70, to reduce the flammability thereof during the relatively extended (normally at least two weeks) period of display thereof. This water may be readily periodically replenished; with any spillage or overflow simply running down the downwardly sloped cover 26 of the stanchion insert 14 through the array of spaced drain holes 36 into the stanchion interior to come to rest at the stanchion bottom 84 as indicated at 86 in drawing FIG. 4. Evaporation of this excess water as indicated at 86 out of the stanchion 14 back up through the array of drain holes 36 may, it is believed, serve to further moisten the Christmas tree 70 and further reduce the flammability thereof. Of course, upon removal of the Christmas tree 70 from the tree planter stand 10 of our invention at the end of the Christmas season, any excess water 86 remaining at the bottom of the stanchion insert 14 may be readily drained therefrom by the removal of the stanchion insert 14 from the planter 12 and the removal of the drain plug 34 from the former.

With the Christmas tree 70 supported as described from the tree planter stand 10 of our invention, it will be clear that the configuration and relatively extensive surface area of the latter will readily lend themselves to appropriate seasonal decoration to complement the conventional seasonal decoration of the Christmas tree and thus greatly enhance, rather than detract from, the overall attractiveness and beauty of the Christmas tree display as a whole.

In accordance with all of the above, it will be clear that the decorative tree planter stand of our invention provides for the low cost, stable, safe and particularly attractive support and display of Christmas trees; it being clear, however, that the same is not limited in use to Christmas trees, but rather, would be equally adapted to the like support and temporary display of virtually any appropriate kind of tree for virtually any type of occasion calling for the same.

Figure 6:
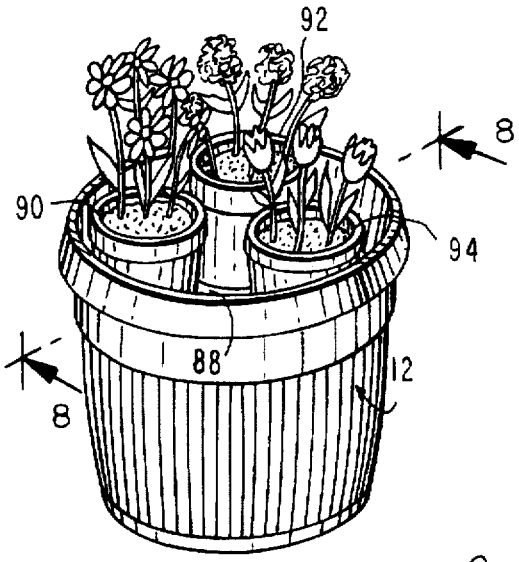
FIG. 6 is a perspective view of the planter of the tree planter stand of FIG. 1 illustrating the optional utilization thereof with a plant support insert for the support and display of potted plants.
Figure 8:
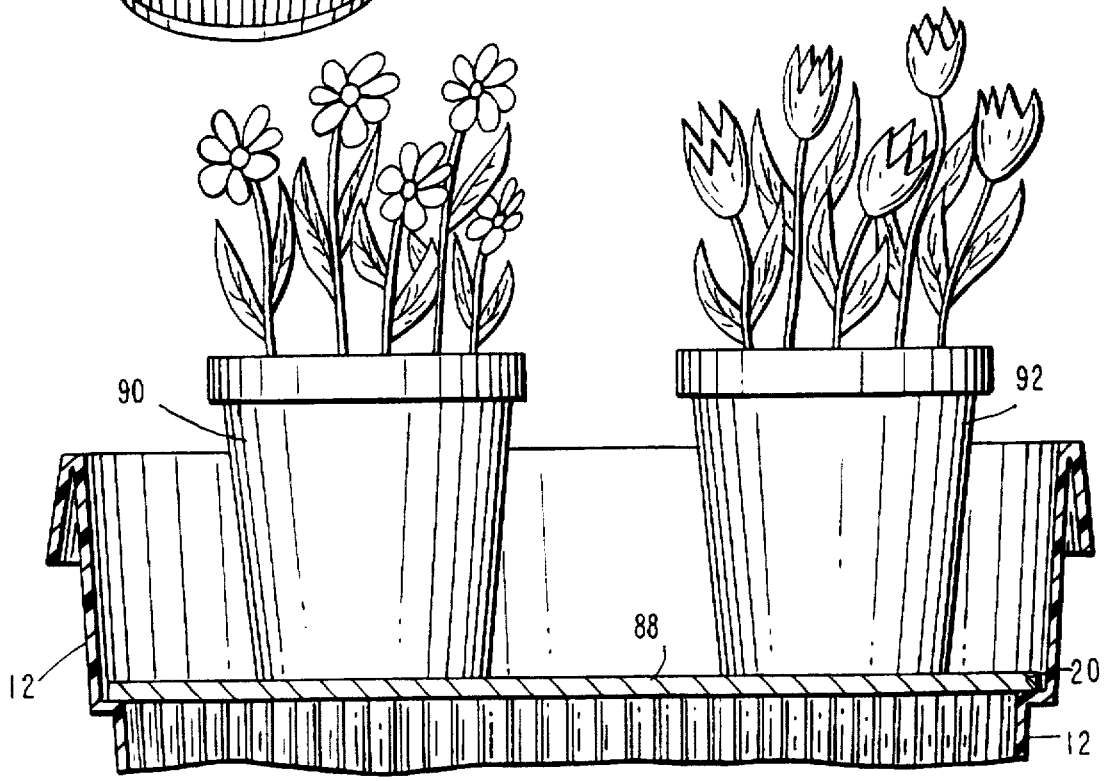
FIG. 8 is a cross-sectional view taken generally along line 8—8 in FIG. 7.

In further accordance with the teachings of our invention, FIGS. 6, 7 and 8 depict a highly practical and attractive use of the planter 12 other than for the support and display of Christmas trees. More specifically, and with reference to those drawing FIGS., it will be seen that through the simple yet ingenious use of a circular plate 88 which is sized to fit and be supported within the planter 12 on the circular support ridge 20 as best seen in drawing FIG. 8, the planter 12 may be readily and conveniently be converted from the support and display of but a single plant into as support for the particularly inexpensive, stable and attractive support of a variety of potted plants as indicated at 90, 92 and 94, respectively. Accordingly, restriction of the use of the planter 12 to support but a single plant is eliminated, and the versatility thereof greatly enhanced.

Various changes may of course be made in the herein disclosed embodiments of our invention without departing from the spirit and scope thereof as defined in the appended claims.

What is claimed is:

1. In a decorative tree support stand which includes a planter, the improvements comprising, a support stanchion insert disposed within said planter and supported therefrom, said support stanchion insert comprising a tree trunk support riser extending upwardly generally centrally thereof and operable to receive and support a tree trunk therefrom, and attachment means operatively associated with said tree trunk support riser and operable to securely grasp the stump of said tree trunk and retain the same firmly supported in said tree trunk support riser, and thus from said planter, said planter including an internal support ridge, said support stanchion insert being generally cylindrical and comprising an enlarged, generally circular cover including a lower support rim, and said support rim being operable to rest upon said planter support ridge to support said support stanchion insert within said planter.

2. In a decorative tree support stand which includes a planter, the improvements comprising, a support stanchion insert disposed within said planter and supported therefrom, said support stanchion insert comprising a tree trunk support riser extending upwardly generally centrally thereof and operable to receive and support a tree trunk therefrom, and attachment means operatively associated with said tree trunk support riser and operable to securely grasp the stump of said tree trunk and retain the same firmly supported in said tree trunk support riser, and thus from said planter, said support stanchion insert being generally cylindrical and comprising a generally circular cover, and said tree trunk support riser being generally cylindrical and extending upwardly generally centrally of said support stanchion insert cover.

3. In a decorative tree support stand as in claim 2, the improvements further comprising, a generally cylindrical water basin insert disposed within and supported from said tree trunk support riser and operable to surround said tree trunk stump within said tree trunk support riser and to moisten the same upon the introduction of water into said water basin insert.

4. In a decorative tree support stand which includes a planter, the improvements comprising, a support stanchion insert disposed within said planter and supported therefrom, said support stanchion insert comprising a tree trunk support riser extending upwardly generally centrally thereof and operable to receive and support a tree trunk therefrom, and attachment means operatively associated with said tree trunk support riser and operable to securely grasp the stump of said tree trunk and retain the same firmly supported in said tree trunk support riser, and thus from said planter, said support stanchion insert being generally cylindrical and comprising a generally circular cover, said tree trunk support riser being generally cylindrical and extending upwardly generally centrally of said support stanchion insert cover, a generally cylindrical water basin insert disposed within and supported from said tree trunk support riser and operable to surround said tree trunk stump within said tree trunk support riser and to moisten the same upon the introduction of water into said water basin insert, and a plurality of apertures formed in said support stanchion insert cover to surround said tree trunk support riser and operable to receive water as may overflow from said water basin for drainage into said support stanchion insert.

* * * * *